United States Patent [19]

Sato

[11] 4,233,900

[45] Nov. 18, 1980

[54] LABEL STRIP CHARGING MECHANISM FOR HAND LABELER

[75] Inventor: Yo Sato, Tokyo, Japan

[73] Assignee: Kabushiki Kaisha Sato Kenkyusho, Tokyo, Japan

[21] Appl. No.: 938,422

[22] Filed: Aug. 31, 1978

[30] Foreign Application Priority Data

Sep. 2, 1977 [JP] Japan ..... 52-105008

[51] Int. Cl.[2] ..... B41F 1/08; B65C 9/18; B65C 11/02

[52] U.S. Cl. ..... 101/288; 101/297; 156/384; 156/541; 156/577; 156/579; 156/584; 156/DIG. 33; 156/DIG. 49

[58] Field of Search ..... 156/384, 574, 577, 579, 156/584, 541, 277, DIG. 33, DIG. 49; 101/287, 288, 291, 292, 297; 400/134.5, 134.6

[56] References Cited

U.S. PATENT DOCUMENTS

| | | | |
|---|---|---|---|
| 2,656,944 | 10/1953 | Swett | 156/384 |
| 3,782,279 | 1/1974 | Carboni, Jr. et al. | 156/384 X |
| 3,800,701 | 4/1974 | Martin | 101/288 |
| 3,911,817 | 10/1975 | Becker et al. | 156/384 X |
| 3,934,507 | 1/1976 | Geri | 156/384 X |
| 4,026,758 | 5/1977 | Sato | 156/579 X |
| 4,116,746 | 9/1978 | Hamisch, Jr. | 156/579 X |
| 4,148,679 | 4/1979 | Hamisch, Jr. | 156/384 |

*Primary Examiner*—Michael G. Wityshyn
*Attorney, Agent, or Firm*—Ostrolenk, Faber, Gerb & Soffen

[57] ABSTRACT

A label strip charging mechanism for use in a hand labeler which is equipped with a feed mechanism having a feeding roller for feeding a continuous label strip: The label strip charging mechanism includes a pressure plate which is made pivotable with respect to the hand labeler and which is formed with a curved surface that follows the profile of the outer periphery of the feeding roller. A coil spring is connected to the pressure plate so as to normally bias the plate away from the feeding roller. A snap connection is used to retain the pressure plate in the vicinity of the feeding roller, against the bias of the coil spring at a position to form a restricted passage for the label strip. An actuating lever of the pressure plate is manually operated to release the snap connection so that the pressure plate can be moved away from the feeding roller by the action of the coil spring to establish an enlarged clearance thereby to facilitate charging of the label strip.

22 Claims, 5 Drawing Figures

LABEL STRIP CHARGING MECHANISM FOR HAND LABELER

BACKGROUND OF THE INVENTION

1. Field of the Invention

The present invention relates to a label printing and applying machine, particularly of the portable type (which will hereafter be referred to as a "hand labeler"), and more particularly to a label strip charging mechanism for use in the hand labeler, by which the label feeding roller or other feeding means of the hand labeler can be charged with an unrolled continuous label strip.

2. Description of the Prior Art

In a hand labeler, or the like apparatus, a rolled label strip is paid out and is fed to a printing position, i.e. onto a platen. To prepare for these operations, the preformed slits in the continuous label strip have to be fitted in advance on the feeding projections which are formed on the outer periphery of a label strip feeding roller. This roller is rotatably mounted in the body of the hand labeler. When the feeding roller is rotated, it draws the label strip off a supply roll and feeds the label strip to the printing position.

In order to ensure smooth label strip feeding, the feeding roller has to be initially charged with the continuous label strip such that the label strip is brought into close contact with the feeding roller. Thus, prior art hand labelers may include a label strip charging mechanism. This mechanism may include a pressure plate that is formed with a curved surface that follows the profile of the outer peripheral surface of the feeding roller. During the label strip charging operation, the pressure plate is turned by suitable means to establish an enlarged clearance between itself and the feeding roller. Then, the leading end of the continuous label strip is inserted into that clearance space, and the slits of the label strip are fitted on the projections of the feeding roller. Afterward, the pressure plate is rotationally returned to its original position so that the label strip may be brought into close contact with the outer peripheral surface of the feeding roller. See, for example, U.S. Application No. 837,193, filed Sept. 28, 1977.

However, conventional label strip charging mechanisms are complicated and are composed of a great number of parts. Moreover, the turning operation of the pressure plate apart from and toward the feeding roller cannot be accomplished efficiently, because it requires considerable skill.

SUMMARY OF THE INVENTION

It is, therefore, a primary object of the present invention to provide a label strip charging mechanism for use in a hand labeler, which mechanism is free from the drawbacks of conventional charging mechanisms.

Another object of the present invention is to provide a label strip charging mechanism of the above type, which is of simple construction and wherein the charging of a continuous label strip can be accomplished without any difficulty at high speed.

A further object of the present invention is to provide a label strip charging mechanism of the above type, in which the label strip can be brought into engagement with its feeding roller so that it can thereafter be unrolled and fed to its printing position without fail.

The present invention provides a label strip charging mechanism for use in a hand labeler, wherein the labeler includes a feed mechanism having a feeding roller that is rotatably mounted on the frame of the hand labeler for unrolling and feeding a continuous label strip. The label strip charging mechanism comprises a pressure plate having one portion that is pivotally connected to the frame of the hand labeler or that is at least pivotable with respect to that frame. The pressure plate is formed with a curved surface that follows the profile of the outer peripheral surface of the feeding roller. An actuating lever is connected to the pressure plate preferably at the end portion thereof away from platen, with respect to the path of the label strip through the labeler. Biasing means are connected to the pressure plate for biasing the plate apart from said feeding roller. Retaining means retain the pressure plate in the vicinity of the feeding roller at a position to form a restricted passage for the continuous label strip between the pressure plate and the feeding roller. The actuating lever is manually operated to release the retaining means so that the pressure plate can be moved apart from the outer peripheral surface of the feeding roller by the action of the biasing means. This establishes an enlarged clearance between the feeding roller and the pressure plate, thereby to facilitate the charging of the label strip.

Other objects and features of the invention can be seen from the following detailed description and the accompanying drawings.

DESCRIPTION OF THE PREFERRED EMBODIMENT

A label strip charging mechanism according to the present invention is now described in conjunction with the accompanying drawings.

Figure 1:
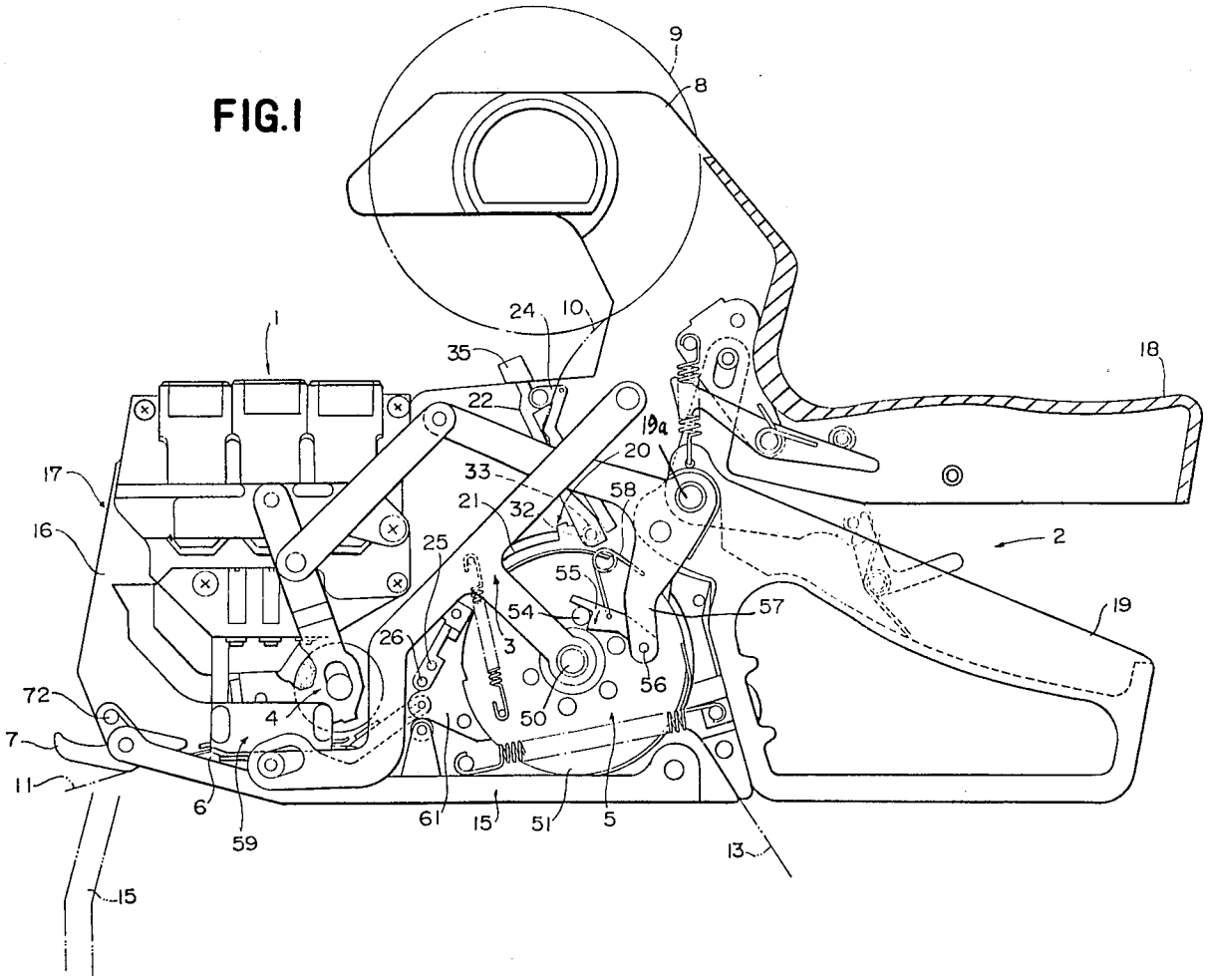
FIG. 1 is a side elevational view showing a hand labeler that is equipped with a label strip charging mechanism of the invention, with the machine frame on the viewing side removed.

Referring to FIG. 1, a hand labeler is shown. It is comprised of a pair of parallel side frame plates 16 connected at their front, center, rear and lower portions by means of a plurality of support shafts, spindles, spring mounting shafts and stop pins, which together constitute a frame 17 of a hand labeler. The hand labeler has a printing head 1 located at a front upper portion of the frame 17. There is a drive mechanism 2 comprised of a stationary grip 18 integrally formed with the frame 17 at the rear (right hand) portion of the frame. A hand lever 19 is pivotally attached to the frame 17 at pivot **19*a* and pivots toward and away from grip 18. A constant pressure printing mechanism 3 of the type shown in U.S. Pat. No. 4,057,452, for example, incorporated by reference, is located at a center portion of the frames. An ink supply mechanism 4 is located at a front lower portion of the frame 17 and is driven, through appropriate links, by hand lever 19, as shown in U.S. Application Ser. No. 716,934, filed Aug. 23, 1976, now abandoned and replaced by Ser. No. 3,626, filed Jan. 15, 1979, a continuation of Ser. No. 716,934, for example, incorporated by reference. There is a feed mechanism 5 at a center lower portion of the frame. A peeling device 6 for peeling a label from the backing strip, is located at a front lower portion of the hand labeler. A label applying device 7 for applying a printed, separated label is located at a front lower end portion of the frame 17. A label strip holder 8 for holding a rolled continuous label strip 9** is located at a center upper portion of the frames.

Above the feed mechanism 5, there is a label strip charging mechanism 20 according to the present invention.

Figure 2:
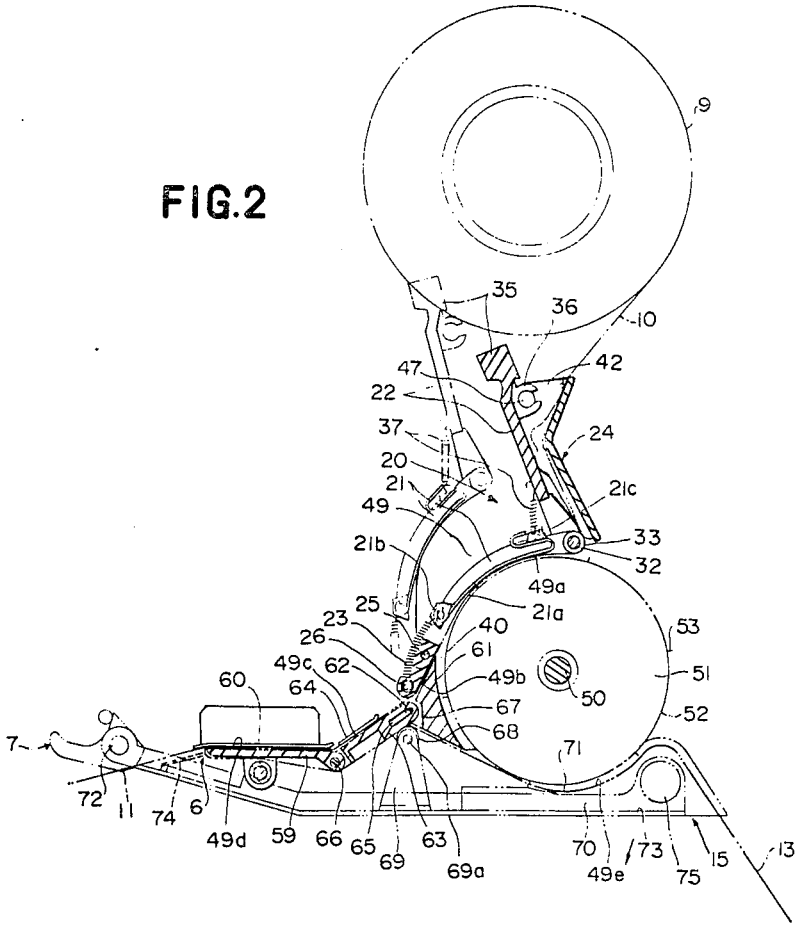
FIG. 2 is a sectional view of the label strip charging mechanism.

The feed mechanism 5 is comprised of a feeding roller 51 which is made rotatable in response to the releasing from being squeezed of the hand lever 19. As shown in FIG. 2, the feeding roller 51 has, on its outer periphery 52, a plurality of rows of feeding claws 53, which are spaced equidistantly from one another around the roller. The feeding roller 51 is mounted on a spindle 50, which is, in turn, rotatably supported in the frame 17. Both sides of the roller 51 carry indexing pins 54 which are arranged on a circle concentric to the spindle 50 and they are equidistantly spaced from one another.

Hooks 55 are pivotally connected by means of hook pins 56 to drive levers 57. The hooks 55 and drive levers 57 pivot together with the hand lever 19, and the hooks 55 are biased to turn counterclockwise by the springs 58. As a result, the leading ends of the hooks 55 are brought into engagement with each indexing pin 54 in turn, like a ratchet feed, so that the feeding roller 51 may be rotated counterclockwise in FIGS. 1 and 2 intermittently about the spindle 50.

Referring to FIG. 2, in front of the feeding roller 51 and below a pressure plate 21, there is a guide plate 61 for an unrolled continuous label strip 10. The plate 61 is fixed to the frame 17. There is a clearance passage 49 for the label strip 10 past the feed roller 51.

A pin 62 is fitted in the side walls 67 of front portions of the guide plate 61. There is a passage plate 63 which has slots 65 formed at its rear portions. The pin 62 is loosely fitted in the slots 65. The front end of the passage plate 63 is pivotally connected by a pin 66 to the rear end of a platen 59 of the constant pressure printing mechanism 3. The passage plate 63 is covered with a cover plate 64 such that there is formed above the passage plate 63 a clearance which is slightly taller than the thickness of the unrolled continuous label strip 10. This defines a passage **49*c*, through which the label strip 10 can pass, while the cover plate 64 prevents the label strip from moving upward apart from the passage plate 63**. An example of the passage plate arrangement can be seen in copending Application Ser. No. 938,421, filed of even date herewith, entitled "Label Strip Jam Preventing Mechanism for Hand Labeler".

The unrolled continuous label strip 10 runs on the passage plate 63 and then further runs over the platen 59 until it passes through a passage **49*d* which is formed between the platen 59 and a label guide plate 60. After passing over the platen, the continuous label strip 10 passes the peeling device 6 in front of the passage 49*d* where it is separated into a series of separate labels 11 and their backing paper 13 and only the backing paper is turned rearward and is guided along the underside of the feeding roller 51**.

For guiding the backing paper toward the feeding roller 51, there is a bottom cover 15, which has a dish-shaped bottom plate 73. The bottom cover is pivotally connected at its forward end to the frame 17 by a pivot pin 72. A label receiver 74 is located to the rear of the pivot pin 72. Behind the label receiver 74, there is a support base 69, on the upper end of which a backing paper carrier roller 68 is rotatably supported by means of a pivot pin **69*a*. Behind the support base 69, there is a backing paper guide 70, which is formed with a curved surface 71 that faces to the lower outer periphery of the feeding roller 51. From the peeling device 6, the backing paper is directed to pass through a passage 49*e* which is formed between the curved surface 71 of the backing paper guide 70 and the outer peripheral surface 52 of the feeding roller 51**.

All of the label receiver 74, the support base and the backing paper guide 70 are secured to the bottom plate 73 of the cover 15 in the above described positional relationships. The bottom cover 15 is disengaged from the frame 17 when release buttons 75 are depressed by the fingers of an operator, so that the plate can rotate downwardly about the pivot pin 72 until it is opened to the position shown in dash dotted lines in FIG. 1.

The aforementioned label applying device 7 receives labels after they have passed over the platen. The label applying device is pivotally mounted to the frame 17 at pivot 72. The device 7 is operative to apply the labels 11, that have been peeled from the backing paper 13 and have been delivered to the outside of the frame 17, to a commodity.

Figure 3:
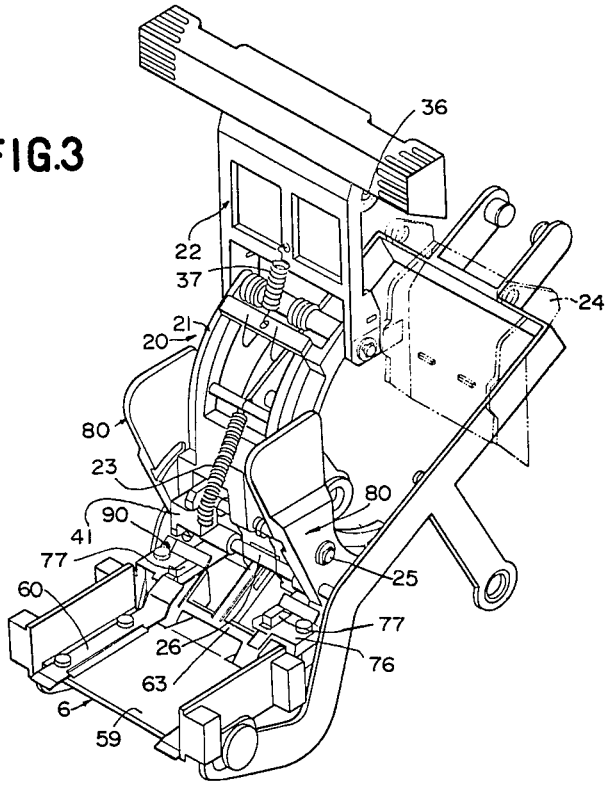
FIG. 3 is a perspective view of the label strip charging mechanism.
Figure 4:
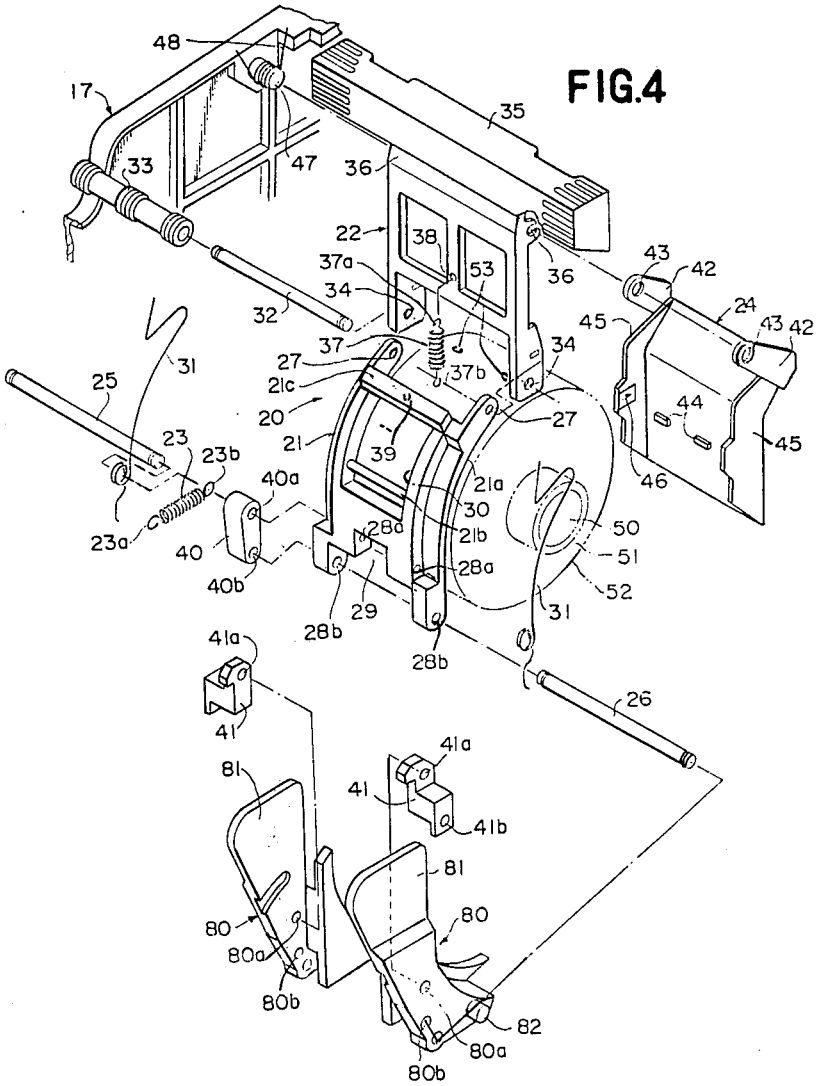
FIG. 4 is an exploded perspective view of the label strip charging mechanism.

Referring to FIGS. 2–4, the label strip charging mechanism 20 according to the present invention is now described. As seen in FIG. 4, the label strip charging mechanism 20 includes the pressure plate 21, which has its lower end pivotally connected to the guide plate 61 at pin 26. The pressure plate 21 has a curved surface **21*a* that is opposed to and corresponds to the outer peripheral surface 52 of the feeding roller 51**.

There is an actuating lever 22, which is pivotally attached to an upper portion of the pressure plate 21, away from the passage plate 63 and the platen 59 along the path of the label strip. There is an elastic member 23 which is attached to a lower portion of the pressure plate relatively nearer to the passage plate. There are label edge guide members 80 below and forward of the roller 51 for guiding the label strip as described below. A label strip guide member 24, supported as described below, is positioned above and upstream of the feeding roller 51 and also faces toward the actuating lever 22. The guide member 24 is spaced from the actuating lever 22 to define between the actuating lever and the label strip guide member a pathway for the label strip. All of the components 22, 24 and 80 are made from a synthetic resin material.

There is a pin 32 on which a roller 33 for the unrolled continuous label strip 10 is rotatably mounted. The roller 33 facilitates the motion of the label strip. Pin 32 is fitted in the pin holes 27, which are formed at both ends of the upper portion of the pressure plate 21, and is fitted in the pin holes 34, which are formed at both ends of the lower portion of the actuating lever 22. A coil spring 37 is interposed between the pressure plate 21 and the actuating lever 22 so that the pressure plate is normally biased to move apart from the feeding roller 51 and from the actuating lever. One end **37*a* of the coil spring 37 is retained in a hole 38 of the actuating lever 22 and the other end 37*b* of the coil spring is retained in a hole 39 which is formed in a spring receiving portion 21*c* of the pressure plate 21, as seen in FIG. 4**.

The lower portion of the pressure plate 21 includes a recess 29, which has pin holes **28*a* at the sides of its upper, narrower width portion and pin holes 28***b* at the sides of its lower, greater width portion. A support pin 25 is fitted in the upper pin holes 28*a*. The pin 25 is attached to the label edge guide member 80 fixed to the frame 17. Another support pin 26 is fitted in the lower pin holes 28*b*.

The elastic member 23 is a coil, tension spring mounted under tension between the support pin 26 and the pressure plate 21. One end 23*a* of spring 23 is retained on the support pin 26 and the other end 23*b* of spring 23 is retained on the spring pin 21*b* on plate 21. A pressure member 40 for the center portion of the label strip is fitted on the center of the support pins 25 and 26, and the pins 25 and 26 are fitted in the pin holes 40*a* and 40*b*, respectively formed in the member 40. Pressure members 41 are fitted on the same pins at both sides of the recess 29, and the pins 25 and 26 extend into the pin holes 41*a* and 41*b*, respectively, formed in the pressure members 41.

The pressure plate 21 has an opening 30 at its center portion. A pair of torsion springs 31 are interposed between the support pin 25 and the spring receiving portion 21*c* of the plate 21 so that the unrolled continuous label strip 10 is urged toward the outer peripheral surface of the feeding roller 51 as it is passed through the clearance between the feeding roller 51 and the pressure plate 21.

The actuating lever 22 includes a knob portion 35 and also includes a pair of notches 36 which are located at the rear of and at both ends below the knob portion 35. These notches 36 are sized and shaped to be removably snapped upon a pair of support pins 47, which are fixed to the frame 17. The ends of the support pins 47 are snugly fitted in the notches 36 of the actuating lever 22. The flexibility of the synthetic resin material of which the actuating levers are comprised permits the snap attachment. This retains the notches 36 of the actuating lever 22 on the support pins 47.

An upright label strip guide member 24, which is pivotally supported in an elastic manner, is located at the rear of the actuating lever 22 and the lever 22 is, in turn, arranged above the feeding roller 51. At its upper portion, the label strip guide member 24 includes a pair of forwardly projecting arms 42, which have holes 43 through their forward ends. The support pins 47 fixed on the frame are fitted in the holes 43. Springs 48 are mounted on pins 47 in a manner that cause the ends of the springs to contact the frame 17. The label strip guide member 24 is continuously urged clockwise, i.e. toward the actuating lever 22, by the action of the springs 48 and it rocks about the support pins 47.

Figure 5:
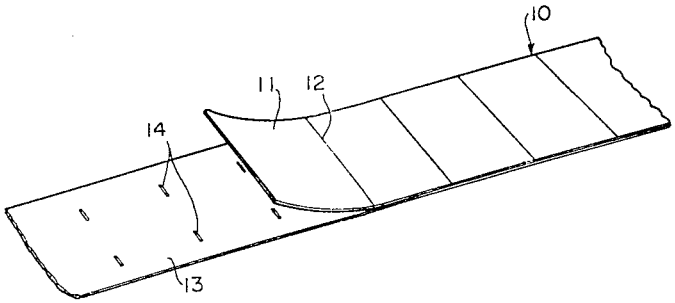
FIG. 5 is a perspective view showing a continuous label strip which is used in conjunction with the invention.

The label strip guide member 24 includes claws 44 on its forward face, which are arranged to engage with slits 14 formed in the backing paper 13 of the unrolling continuous label strip 10. As shown in FIG. 5, the continuous label strip 10 comprises a series of the labels 11, which are overlaid in a row on the backing paper 13 which has slits 12 at a preset pitch or spacing. Both side walls 45 of the label guide member 24 guide both edges of the continuous label strip 10 when the strip is moving. The side walls 45 have arrow marks 46 formed on their inner surfaces, and they are positioned to correspond to the claws 44.

The pair of label edge guide elements 80 are arranged at both sides of the feeding roller 51 so as to regulate the edges of the continuous label strip 10 to prevent it from meandering. The upper portions of the guide elements 80 include upwardly extending, upright label regulating portions 81. At their lower portions, the guide elements have pin holes 80*a* and 80*b*, in which the support pins 25 and 26 are respectively fitted. The guide elements 80 have projections 82 formed on their outer sides. The projections 82 are fitted in the frame 17 and thereby fix the locations of the guide elements 80 with respect to the frame.

The charging operation for a continuous label strip is now described. First, the knob portion 35 of the upper end of the actuating lever 22 is pinched and is pulled forward (left in the drawings) of the hand labeler which releases the retaining means 36. After disengagement of the notches 36 of the actuating lever 22 from the support pins 47, the pressure plate 21 is automatically turned counterclockwise toward the front of the hand labeler, primarily by the elastic action of the elastic member 23 and secondarily by the action of the coil spring 37, until the pressure plate 21 is brought into the position shown in double dotted lines in FIG. 2. This establishes an enlarged clearance 49 between the actuating lever 22 and the label guide member 24 and the clearance continues between the rearwardly facing curved surface of the pressure plate 21 and the opposed outer peripheral surface of the feeding roller 51, thus facilitating charging of the continuous label strip through the clearance.

The lock buttons 75 of the bottom cover 15 are depressed, which permits the cover 15 to be turned clockwise about the pivot pin 72 to the position shown in double dotted lines in FIG. 1.

Then, the continuous label strip 9 is unrolled or drawn out from the label holder 8 and the leading end of the continuous label strip 10 is inserted, while being guided above the label guide member 24, into the enlarged clearance 49 between the pressure plate 21 and the feeding roller 51.

The slits 14 in the second row of the label strip 10, measured from the leading end of the backing paper 13, are then brought into engagement with the claws 44 of the label guide member 24. After that, the actuating lever 22 is pushed back from its fully open condition against the actions of the elastic member 23 and of the coil spring 37 until its notches 36 are restored to their retained conditions over the support pins 47. Following this restoring motion of the actuating lever 22, the pressure plate 21 holds the continuous label strip 10 in position in the now restricted or narrowed clearance 49 between the pressure plate 21 and the feeding roller 51, such that the label strip 10 is urged onto the feeding roller 51. In these ways, the setting operations of the label strip 10 are finished.

During the foregoing setting operations, the backing paper 13 of the continuous label strip 10 has its first row of slits 14 fitted without fail on the feeding claws 53 on the outer peripheral surface 52 of the feeding roller 51.

In response to the intermittent rotation of the feeding roller 51 of the feed mechanism 5, which occurs as a result of releasing the hand lever after the grip 18 and the hand lever 19 had been squeezed, the continuous label strip 10 advances through the passage 49*a*, in FIG. 2, between the outer peripheral surface 52 of the feeding roller 51 and the curved surface 21*a* of the pressure plate 21, and advances further through the label passages 49*b* to 49*d* before it reaches the peeling device 6.

At the peeling device 6, only the backing paper 13 of the label strip 10 is turned and guided over the underside of the platen 59, and the slits 14 of the backing paper 13 are brought into engagement with the feeding claws 53 at the lower side of the feeding roller 51.

As the bottom cover 15 is being closed, the backing paper 13 is arranged in the passage 49*e* which is defined between the curved surface 71 of the backing paper guide 70 and the outer peripheral surface 52 at the lower side of the feeding roller 51. After that, the bottom cover 15 is closed to its initial position, thus finishing the charging operations of the unrolled continuous label strip 10.

As has been described hereinbefore, the label strip charging mechanism according to the present invention includes a pressure plate, which is movable toward and away from a label feeding roller, an actuating lever connected to the pressure plate and which is equipped with a snap member that retains the actuating lever toward the feeding roller, and the actuating lever is manually actuatable to turn the pressure plate toward and away from the label feeding roller, and an elastic member which is operative to normally bias the pressure plate apart from the feeding roller.

One advantage of the present invention is that the pressure plate can be turned forward apart from the feeding roller merely by separating the notches of the actuating lever from their retained condition on their support pins. As a result, an enlarged clearance is established between the pressure plate and the feeding roller so as to facilitate insertion of the continuous label strip.

Since the labeler includes a label strip guide member, which is juxtaposed to an actuating lever and which is made coactive with a pressure plate, the label strip can always be guided to a position in front of the feeding roller while being prevented from advancing, or perhaps drooping, to the rear of the feeding roller.

Moreover, since the label strip guide member has a row of claws formed on its front surface, which are arranged to correspond to the slits of the label strip and to have the same pitch as the feeding claws formed on the feeding roller, the label strip can have its slits fitted in position on the feeding claws of the feeding rollers merely by bringing respective other slits into engagement with the claws of the label guide member. Thus, reliable label feeding can be ensured.

Furthermore, since a pair of label edge guide elements are arranged at the both sides of the feeding roller, the label strip can be regulated widthwise. Thus, the label strip can be effectively prevented from meandering while it is advancing.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A hand labeler, comprising:

a frame, a printing head carrying types to be printed on a label; a platen opposable to said types; means for moving at least one of said printing head and said platen for bringing said types into engagement with a label on said platen;

a feeding roller supported on said frame for feeding a label strip comprised of a series of labels to said platen; means for rotating said feeding roller;

a label strip charging mechanism located upstream of said platen, with respect to the travel of the label strip through said labeler; said charging mechanism comprising a pressure plate positioned near said feeding roller for defining a passage for the label strip between said pressure plate and said feeding roller; said pressure plate including a portion which is connected to be supported by said frame for movement with respect to said frame;

biasing means connected to said pressure plate for biasing said pressure plate apart from said feeding roller, thereby defining a relatively less restricted passage between said pressure plate and said feeding roller for the label strip;

retaining means for retaining said pressure plate in the vicinity of said feeding roller against the bias of said biasing means, thereby defining a more restricted passage between said pressure plate and said feeding roller for the label strip;

an actuating lever connected to said pressure plate; said actuating lever being operable for releasing said retaining means so that said pressure plate can be moved by said biasing means, whereby an enlarged clearance between said feeding roller and said pressure plate is formed to facilitate charging of the label strip.

2. The hand labeler of claim 1, wherein said pressure plate includes a surface which is opposed to said feeding roller and which is curved to follow the profile of said feeding roller, for directing the label strip against said feeding roller.

3. The hand labeler of claim 1, wherein said actuating lever is pivotally connected to said pressure plate; a second biasing means for biasing said actuating lever, with respect to said pressure plate, away from said retaining means.

4. The hand labeler of either of claims 1 or 3, wherein said retaining means comprises a support pin fixed to said frame and further comprises a notch that is formed in said actuating lever and that is placed and shaped to be removably snapped on said support pin.

5. The hand labeler of claim 1, wherein said actuating lever is connected to a portion of said pressure plate that is relatively far from said platen upstream along the path of the label strip.

6. The hand labeler of claim 5, wherein said biasing means is connected to said pressure plate at a second portion of said pressure plate that is relatively nearer to said platen along the path of the label strip.

7. The hand labeler of claim 6, wherein said pressure plate is pivotally connected to said frame so as to pivot with respect to said frame.

8. The hand labeler of claim 7, further comprising a pivot pin on said frame on which said pressure plate is pivotally supported; said biasing means comprises a spring connected with said pressure plate for pivoting said pressure plate about said pivot pin.

9. The hand labeler of claim 8, wherein said actuating lever is pivotally connected to said pressure plate; a second biasing means for biasing said actuating lever with respect to said pressure plate, away from said retaining means.

10. The hand labeler of claim 9, wherein said retaining means comprises a support pin fixed to said frame and further comprises a notch that is formed in said actuating lever and that is placed and shaped to be removably snapped on said support pin.

11. The hand labeler of claim 1, further comprising a label strip guide member upstream of said pressure plate and in the path of movement of the label strip; said guide member having a side placed to be engaged by the label strip, before the label strip passes to said feeding roller; said guide member being so placed as to block the label strip from moving to the side of said feeding roller that is opposite the side of said feeding roller which the label strip engages.

12. The hand labeler of claim 11, wherein said guide member is opposed to said actuating lever at the side of said actuating lever which faces toward the label strip, whereby the label strip passes between said actuating lever and said guide member.

13. The hand labeler of claim 12, further comprising label strip engaging claws formed on said guide member side, thereby to cooperate with said feeding roller for engaging the label strip and for restraining motion of the label strip until said feeding roller rotates.

14. The hand labeler of claim 1, further comprising a pair of label edge guide elements arranged at both sides of said feeding roller for preventing the continuous label strip from meandering while it is advancing.

15. The hand labeler of claim 1, wherein said pressure plate is pivotally connected to said frame so as to pivot with respect to said frame.

16. The hand labeler of claim 15, further comprising a pivot pin at said frame on which said pressure plate is pivotally supported; said biasing means comprises a spring connected between said pressure plate and said pivot pin.

17. A hand labeler, comprising:

a frame, a printing head carrying types to be printed on a label; a platen opposable to said types; means for moving at least one of said printing head and said platen for bringing said types into engagement with a label on said platen;

feeding means for feeding the label strip to said platen;

a label strip charging mechanism located upstream of said platen, with respect to the path of travel of a label strip through said labeler; said charging mechanism comprising a pressure plate positioned near said feeding means for defining a passage for the label strip between said pressure plate and said feeding means; said pressure plate including a portion which is connected to be supported by said frame for movement with respect to said frame;

biasing means connected to said pressure plate for biasing said pressure plate apart from said feeding means, thereby defining a relatively less restricted passage between said pressure plate and said feeding means for the label strip;

retaining means for retaining said pressure plate in the vicinity of said feeding means, thereby defining a more restricted passage between said pressure plate and said feeding means for the label strip;

an actuating lever connected to said pressure plate; said actuating lever being operable for releasing said retaining means so that said pressure plate can be moved by said biasing means, whereby an enlarged clearance between said feeding means and said pressure plate is formed to facilitate charging of the label strip.

18. The hand labeler of claim 17, wherein said actuating lever is pivotally connected to said pressure plate; a second biasing means for biasing said actuating lever, with respect to said pressure plate, away from said retaining means.

19. The hand labeler of claim 17, wherein said retaining means comprises a support pin fixed to said frame and further comprises a notch that is formed in said actuating lever and that is placed and shaped to be removably snapped on said support pin.

20. The hand labeler of claim 17, wherein said pressure plate is pivotally connected to said frame so as to pivot with respect to said frame.

21. The hand labeler of claim 19, further comprising a pivot pin at said frame on which said pressure plate is pivotally supported; said biasing means comprises a spring connected between said pressure plate and said pivot pin.

22. The hand labeler of claim 17, further comprising a label strip guide member upstream of said pressure plate and in the path of movement of the label strip; said guide member having a side placed to be engaged by the label strip, before the label strip passes to said feeding means; said guide member being so placed as to block the label strip from moving to the side of said feeding means that is opposite the side of said feeding roller which the label strip engages.

* * * * *